US005203470A

United States Patent [19]

Brown

[11] Patent Number: 5,203,470

[45] Date of Patent: Apr. 20, 1993

[54] SEPARABLE BAG-IN-BOX COMPOSITE CONTAINER

[75] Inventor: Michael T. Brown, Cincinnati, Ohio

[73] Assignee: The Procter & Gamble Company, Cincinnati, Ohio

[21] Appl. No.: 878,941

[22] Filed: May 5, 1992

[51] Int. Cl.[5] ..... B65D 5/56; B65D 5/74

[52] U.S. Cl. ..... 220/462; 220/410; 220/461; 222/105; 229/125.15

[58] Field of Search ..... 220/403, 408, 410, 461, 220/462, 465; 229/125.15, 125.17; 222/105-107

[56] References Cited

U.S. PATENT DOCUMENTS

| | | | |
|---|---|---|---|
| 2,793,669 | 5/1957 | Clarke | 220/403 |
| 3,108,732 | 10/1963 | Curie et al. . | |
| 3,169,690 | 2/1965 | Scholle . | |
| 3,206,094 | 9/1965 | Humphrey et al. . | |
| 3,233,817 | 2/1966 | Casady | 222/105 |
| 3,262,628 | 7/1966 | Heisler et al. | 220/461 |
| 3,427,646 | 2/1969 | Scholle | 220/410 |
| 3,448,889 | 6/1969 | Malpas | 220/465 |
| 3,724,712 | 4/1973 | Starr et al. | 220/461 |
| 3,918,605 | 11/1975 | Butler | 220/465 |
| 4,165,023 | 8/1979 | Schmit | 222/105 |
| 4,174,051 | 11/1979 | Edwards et al. | 222/105 |
| 4,280,634 | 7/1981 | Wiesenberger et al. | 220/270 |
| 4,524,883 | 6/1985 | Herring | 220/462 |
| 4,572,422 | 2/1986 | Heubergr et al. . | |
| 4,585,143 | 4/1986 | Fremow et al. | 222/105 |
| 4,635,814 | 1/1987 | Jones | 220/461 |
| 4,696,840 | 9/1987 | McCullough et al. | 220/462 |
| 4,771,917 | 9/1988 | Heaps, Jr. et al. | 222/105 |
| 4,890,772 | 1/1990 | Heuberger et al. | 222/156 |
| 4,898,301 | 2/1990 | Schick | 220/408 |
| 5,048,691 | 9/1991 | Heuberger et al. | 220/403 |
| 5,076,471 | 12/1991 | Coleman | 222/105 |
| 5,135,133 | 8/1992 | Frost | 220/465 |

*Primary Examiner*—Gary E. Elkins

*Attorney, Agent, or Firm*—Kevin C. Johnson; E. Kelly Linman; Michael E. Hilton

[57] ABSTRACT

A bag-in-box composite container where the inner bag is easily separable from the outer box. In a preferred embodiment, a rigid one-piece outer box having a continuous side wall and a pair of end panels joined thereto defines a hollow box cavity. At least one of the end panels has a first aperture and at least two additional apertures therein. An inner bag is located within the hollow box cavity of the outer box. The inner plastic bag has a pouring spout with an annular flange connected thereto. The pouring spout extends through the first aperture in the end panel of the outer box. The annular flange of the pouring spout includes a pair of heat stakes which extend through the apertures in the end panel of the outer box. The heat stakes prevent relative rotation between the pouring spout and the outer box while temporarily securing the inner bag to the outer box. Upon emptying of the liquid contents, the inner bag is then separated from the outer box by depressing the pouring spout downward.

19 Claims, 6 Drawing Sheets

SEPARABLE BAG-IN-BOX COMPOSITE CONTAINER

FIELD OF THE INVENTION

The present invention pertains to bag-in-box (BIB) composite containers, and more particularly, to such BIB composite containers wherein the inner bag is easily separable from the outer box.

BACKGROUND OF THE INVENTION

The beverage industry presently uses a wide variety of containers in packaging a vast assortment of materials and combination of materials, e.g., paperboard, glass, metals such as aluminum, and various plastics. Of course, there are advantages and disadvantages associated with each material. For example, wax coated paperboard is a relatively strong and inexpensive container material, but unfortunately it is quite permeable to gases such as oxygen. Therefore, beverages stored in paperboard containers tend to lose their freshness and degrade over a short period of time. In comparison, containers made from glass, metals, and some plastics are relatively impermeable to gases, but are rather expensive due to the high cost of those materials.

In recent years, the beverage industry has turned to bag-in-box (BIB) composite containers to package such products as bulk milk and wine. These BIB composite containers, which basically consist of a plastic inner bag within a sturdy outer paperboard box, combine the low cost strength of paperboard with the protection offered by various plastics. If made of the proper materials, i.e., paperboard for the outer box and plastic for the inner bag, both the inner bag and the outer box can be recycled. However, with most BIB composite containers the inner bag and the outer box are not easily separable from one another.

Some prior art bag-in-box composite containers have an inner bag the spout of which is affixed to the outer container in such a way that it precludes removal of the inner bag from the outer container except for the destruction of the complex attachment mechanism. Other prior art composite bag-in-box containers have an inner bag which is glued to the outer box. Overall, separation of the inner bag from the outer box is difficult with the prior art bag-in-box containers.

SUMMARY OF THE INVENTION

The present invention provides a bag-in-box composite container where the inner bag is easily separable from the outer box. In a preferred embodiment, a rigid one-piece outer box having a continuous side wall and a pair of end panels joined thereto defines a hollow box cavity. At least one of the end panels has a first aperture and at least two additional apertures provided therein. An inner bag is located within the hollow box cavity of the outer box. The inner bag has a pouring spout with an annular flange connected thereto. The pouring spout extends through the first aperture in the end panel of the outer box. The annular flange of the pouring spout includes an attachment means for preventing relative rotation between the pouring spout and the outer box and permits easy separation of the inner bag from the outer box. The attachment means includes at least two attachment members extending from the annular flange. The attachment members extend through the two additional apertures in the end panel of the outer box and are adapted to temporarily secure the inner bag to the outer box.

Preferably the inner bag can be separated from the outer box with a downward force in the range of about 21.5 to about 56.8 newtons. Preferably the bag-in-box container includes an easy opening means in one of the side wall panels. Preferably the attachment means is at least two heat stakes attached to the annular flange of the pouring spout. Preferably the outer surface of the pouring spout includes screw threads. Preferably a screw cap is releasably attached to the screw threads located on the outer surface of the pouring spout.

BRIEF DESCRIPTION OF THE DRAWINGS

While the specification concludes with claims particularly pointing out and distinctly claiming the subject matter of the present invention, it is believed that the present invention will be better understood from the following description and drawings, in which like reference numerals identify identical elements and wherein;

DETAILED DESCRIPTION OF THE INVENTION

Figure 1:
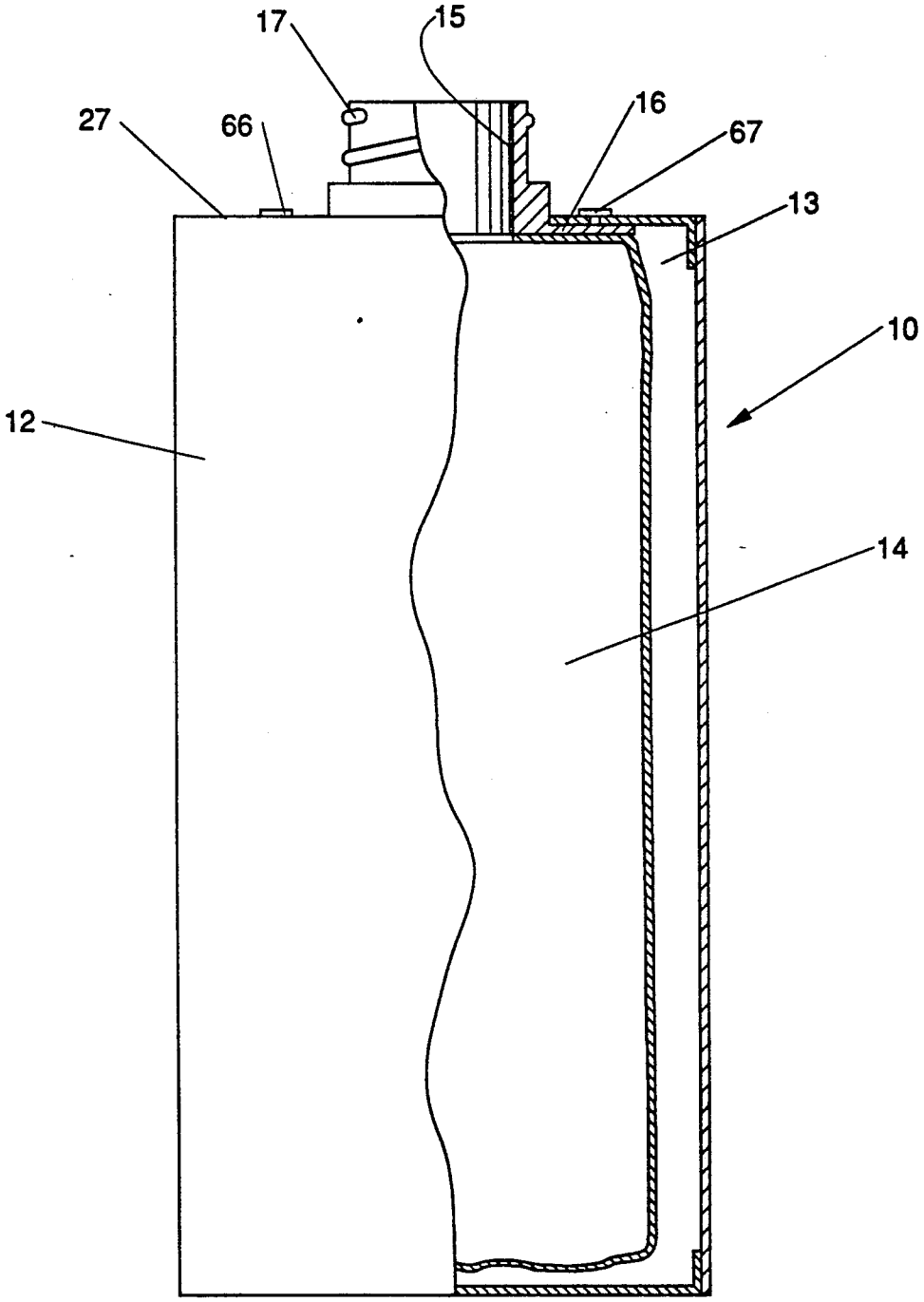
FIG. 1 is a partially cut away elevation view of a bag-in-box composite container of the present invention minus the cap.

FIG. 1 is an elevation view of a preferred bag-in-box (BIB) composite container 10 of the present invention with portions cut away. The BIB composite container 10 comprises an outer carton 12 defining a hollow box cavity 13, and an inner plastic bag 14. The inner plastic bag 14 has a pouring spout 15 with an annular flange 16 attached thereto. The pouring spout 15 extends outside outer carton 12 through aperture 32, shown in FIGS. 2 and 3,located in the top end panel 27 of the outer carton 12. Preferably, the outer surface of pouring spout 15 is provided with closure receiving means, such as screw threads 17, as illustrated. In the preferred embodiment shown in FIGS. 1-3, aperture 32 and pouring spout 15 are located in the center of top end panel 27 of outer carton 12.

Figure 2:
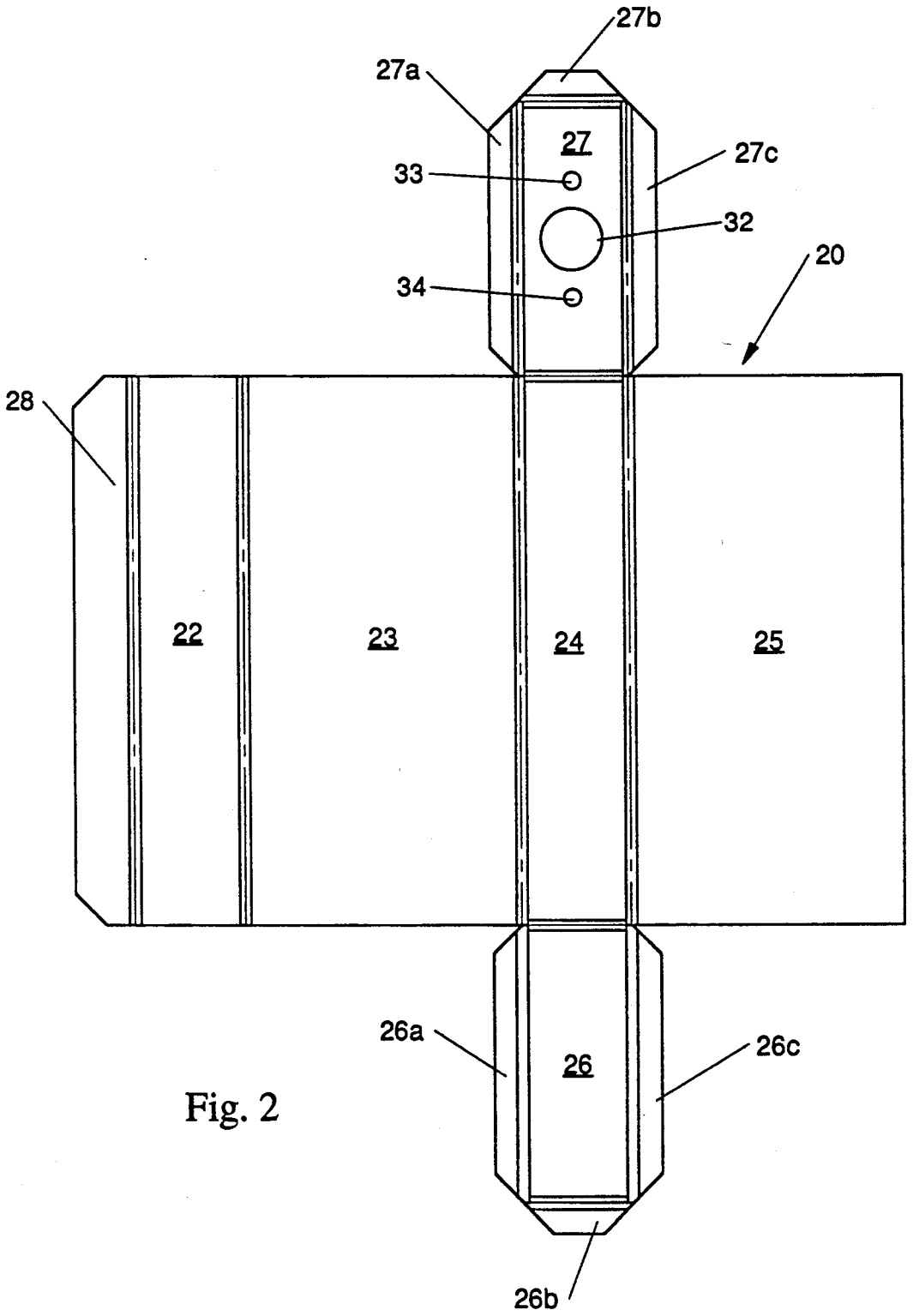
FIG. 2 is a top plan view illustrating a preferred unitary blank that can be used in making bag-in-box composite containers of the present invention.

As will be appreciated by those skilled in the art of BIB composite containers, outer carton 12 can be made from a wide variety of materials as well as assume a wide variety of shapes. For example, outer carton 12 may be made of paperboard, carton board, corrugated board, or the like, and may have a rectangular, square, oval, or circular cross-section. An example of a preferred unitary blank 20 from which outer carton 12 can be made is shown in FIG. 2. In FIG. 2, blank 20 comprises four side wall panels 22, 23, 24 and 25; one bottom end panel 26; three bottom sealing flaps **26*a*, 26*b* and 26*c*; one top end panel 27; three top sealing flaps 27*a*, 27*b* and 27*c*; and a side sealing flap 28**. The dotted lines shown in FIG. 2 represent score lines or hinge lines along which blank 20 is folded in making rectangular outer carton 12. Top end panel 27 has apertures 32, 33 and 34 located therein.

Figure 3:
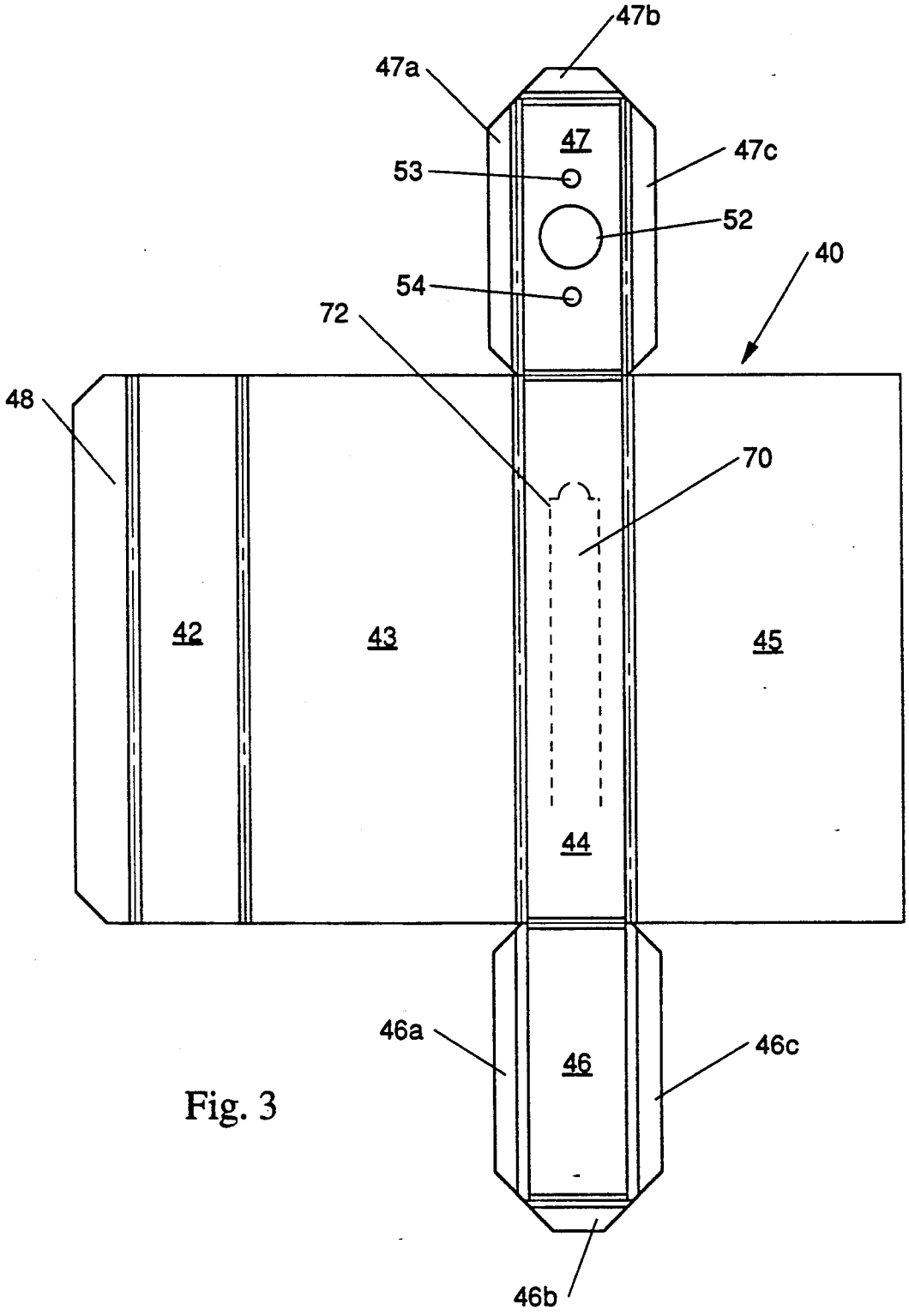
FIG. 3 is a top plan view illustrating another preferred unitary blank that can be used in making bag-in-box composite containers of the present invention.

Another preferred embodiment of a unitary blank from which outer carton 12 can be constructed is shown in FIG. 3. In FIG. 3, blank 40 comprises four side wall panels 42, 43, 44 and 45; one bottom end panel 46; three bottom sealing flaps 46*a*, 46*b* and 46*c*; one top end panel 47; three top sealing flaps 47*a*, 47*b* and 47*c*; and one side sealing flap 48. The dotted lines shown in FIG. 3 represent score lines or hinge lines along which blank 40 is folded in making rectangular outer carton 12. An easy opening means is provided in side wall panel 44 to facilitate removal of the inner bag 14 from the outer carton 12. Preferably, the easy opening means in side wall panel 44 is an opening flap 70 which is defined by a continuous line of weakness 72 located therein. Alternatively, opening flap 70 may be located in either of side wall panels 42, 43 or 45. In addition, the configuration and direction of line of weakness 72, defining opening flap 70, may be altered in numerous ways as will be obvious to those skilled in the art. Top end panel 47 has apertures 52, 53 and 54 located therein.

Preferably, the outer surface of unitary blanks 20 and 40 are printed with graphics, instructions, directions, etc., before blanks 20 and 40 are folded to form bag-in-box composite container 10.

As will be appreciated by those skilled in the art of BIB composite containers, both inner bag 14 and pouring spout 15 can be made from a wide variety of materials as well as assume a wide variety of shapes. For the purpose of achieving a liquid impervious connection between bag and spout, it is generally preferred that these parts be heat sealed to one another. This requires that inner bag 14 and pouring spout 15 comprise materials which are capable of being heat sealed to one another.

In one preferred embodiment, pouring spout 15 may comprise a polyolefin or polyolefin copolymer. In turn, inner bag 14 may also comprise a polyolefin or polyolefin copolymer. Suitable polyolefins include low density polyethylene (LDPE), linear low density polyethylene (LLDPE), medium density polyethylene (MDPE), or high density polyethylene (HDPE). Suitable polyolefin copolymers include ethylene/vinylacetate (EVA), ethylene/methylacrylate (EMA), ethylene/acrylic acid (EAA), ethylene/propylene (EP), or ionomers selected from the family of EAA copolymers in which the acrylic acid groups are neutralized with sodium or zinc ions.

Inner bag 14 may also be a multilayer film, for example a coextruded or laminated film, having polyolefin or polyolefin copolymer heat seal layers on both inner and outer surfaces to aid heat sealing. The multilayer film may comprise any number of layers (preferably 3 to 9) and may include one or more barrier layers to decrease the permeability of atmospheric oxygen or moisture into inner bag 14 or to retard the loss of flavors, aromas, perfumes and other organic species from the product contained in the inner bag. Suitable barrier layers include ethylene vinyl alcohol (EVOH) copolymers, polyvinylidene chloride (PVDC) copolymers, rubber modified acrylonitrile/methyl acrylate coploymers, polyamides, and polyesters. Other suitable barrier layers include metallized films such as polyester or polypropylene. Additional adhesive layers or tie layers may also be present to aid in bonding dissimilar layers to one another.

In another preferred embodiment pouring spout 15 comprises a polyester such as polyethylene terephthalate (PET), or preferably a more readily heat sealable polyester copolymer such as a glycol modified PET copolymer (PETG). Inner bag 14 may comprise a single layer of PETG, or other heat sealable polyester copolymer. Inner bag 14 may also comprise a multilayer structure in which both inside and outside layers are made from PETG or other heat sealable polyester copolymer. The multilayer structure may also include additional barrier layers as described above, or, in a particularly preferred embodiment, PET film coated with a thin film of glass, silicon diozide, aluminum oxide, or other ceramic material. Additional adhesive layers may also be present to aid in bonding the PETG or other heat sealable polyester copolymer layers to both sides of the ceramic coated PET film or other barrier layers.

Figure 4:
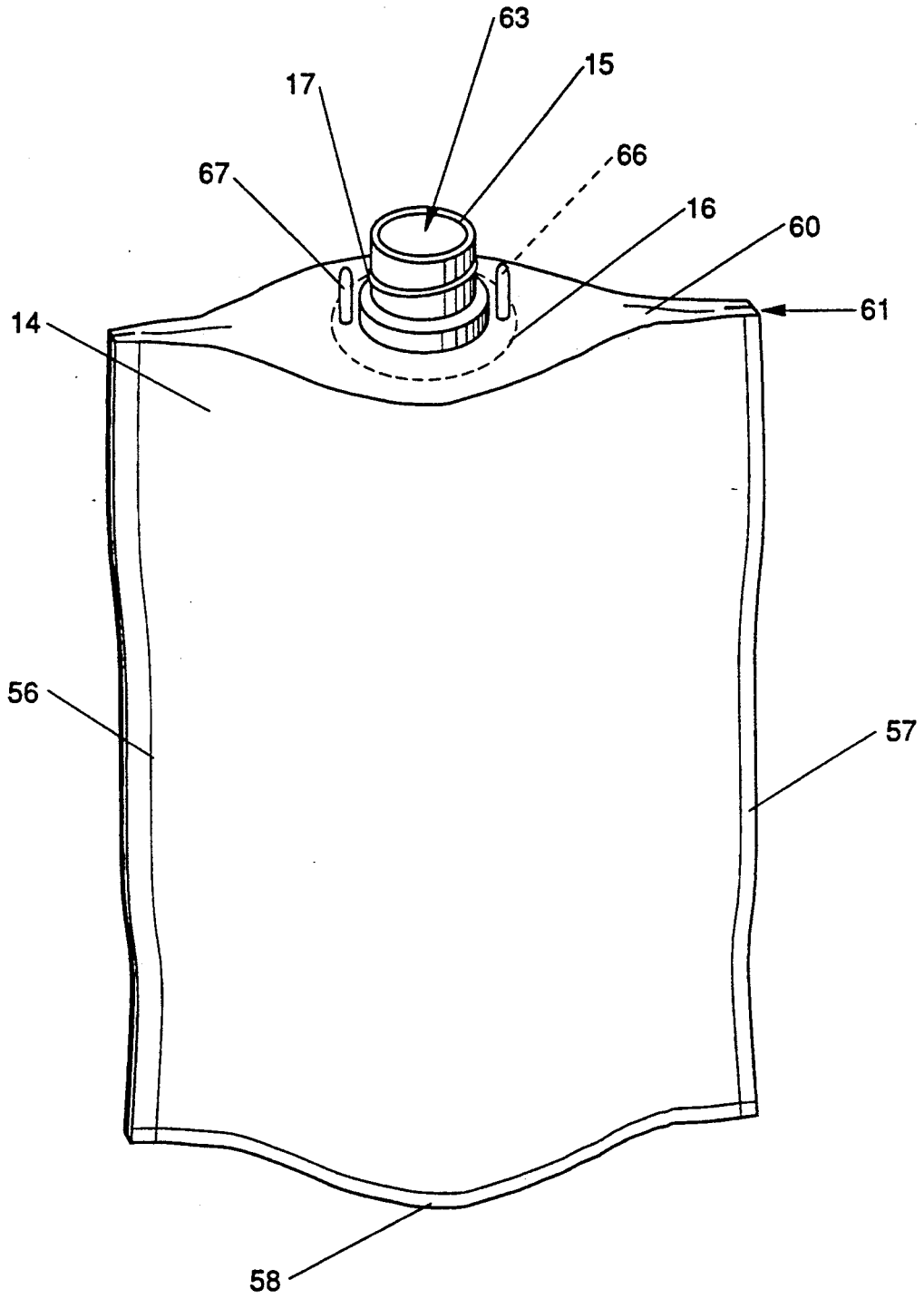
FIG. 4 is a perspective view of a preferred inner bag that can be used in making bag-in-box composite containers of the present invention.

An example of a preferred inner bag 14 is shown in FIG. 4, inner bag 14 is heat sealed along its side peripheral edges 56 and 57 forming a gusset 60 in the top portion 61 of inner bag 14. Inner bag 14 is also heat sealed along bottom peripheral edge 58. An aperture 63 is cut in the central portion of gusset 60. A pouring spout 15 having an annular flange 16 is heat sealed to the portion of gusset 60 surrounding aperture 63. Pouring spout 15 preferably has a closure receiving means, such as screw threads 17, on its outer surface. Extending upwardly from annular flange 16 is preferably a means for attaching the spout (and therefore the bag) to the outer carton and preventing relative rotation between the pouring spout 15 and the outer carton 12. In addition, the attachment means temporarily secures the inner bag 14 to the outer carton 12 while permitting easy separation of the inner bag 14 from the outer carton 12 upon emptying the contents from the inner bag 14. The attachment means extending upwardly from annular flange 16, preferably comprises two heat stakes 66 and 67.

Figure 5:
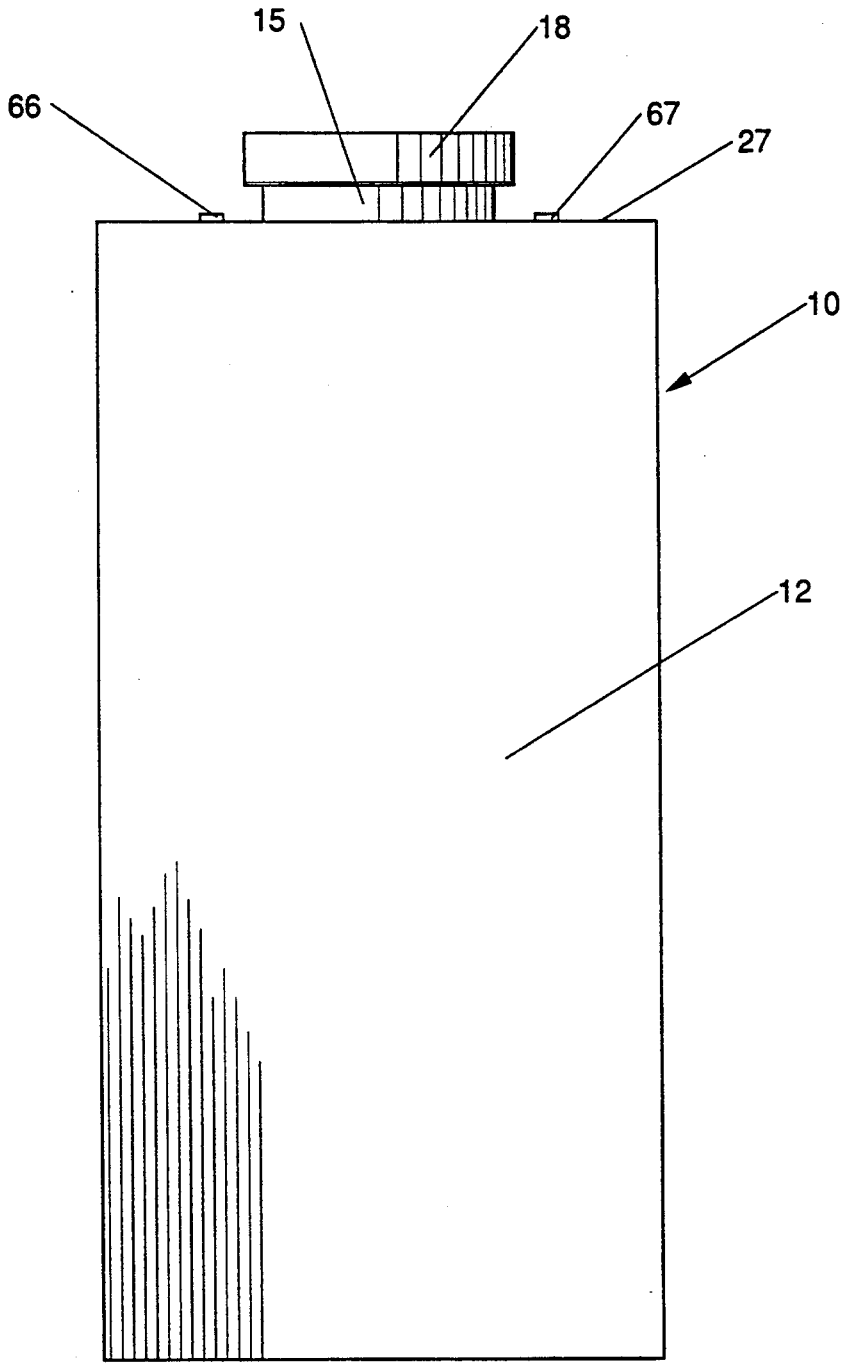
FIG. 5 is an elevation view of the bag-in-box composite container of FIG. 1 including the cap.

To form the BIB composite container 10 of the present invention, as seen in FIGS. 1 and 5, pouring spout 15 is thermally bonded to inner bag 14 in the portion of gusset 60 surrounding aperture 63. Inner bag 14 is then sealed along side peripheral edges 56 and 57 and along bottom peripheral edge 58. Pouring spout 15 and heat stakes 66 and 67 are then simultaneously inserted through apertures 32, 33 and 34 located in top end panel 27, respectively. Prior to exposing heat stakes 66 and 67 to a heat source, their diameter is slightly smaller than that of apertures 33 and 34. After insertion through apertures 33 and 34 in top end panel 27, heat stakes 66 and 67 are then exposed to a heat source expanding their distal ends to a dimension slightly greater than that of apertures 33 and 34 in top end panel 27. Preferably, a downward force in the range of about 21.5 to about 56.8 newtons is required to separate heat stakes 66 and 67 from top end panel 27. This can be accomplished in a BIB composite container 10 the outer carton 12 of which is constructed of 28-point (0.028 inch thick) solid bleached sulfite carton board with apertures 33 and 34 in top end panel 27 having a diameter of 3.35cm, and the distal ends of heat stakes 66 and 67 having a diameter of 4.75mm. Heat stakes 66 and 67 provide means for preventing relative rotation between the pouring spout 15 and the outer carton 12 while temporarily securing inner bag 14 to outer rigid container 12. Outer rigid carton 12 is folded along the score lines and then glued along the sealing flaps to the respective side panels. The inner bag 14 is filled with the desired liquid and then sealed with a closure cap 18 shown in FIG. 6, using screw threads 17 provided on the outer periphery of pouring spout 15.

Figure 6:
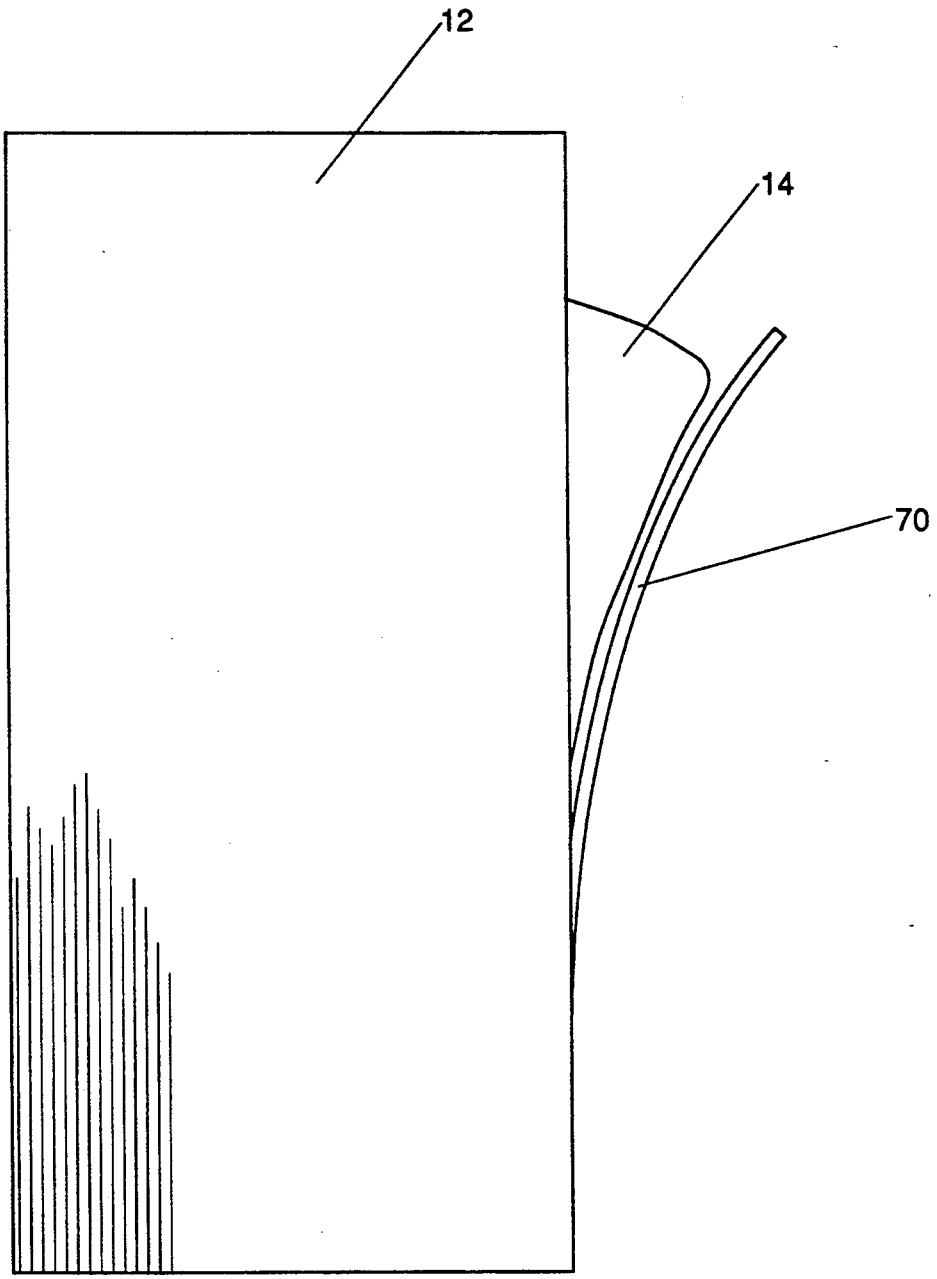
FIG. 6 is an elevation view of the bag-in-box composite container of FIG. 1 illustrating the removal of the inner bag from the outer box.

In use a consumer simply removes screw cap 18 from pouring spout 15 and pours the contents from the inner bag 14. Heat stakes 66 and 67 prevent relative rotation between the pouring spout 15 and the outer carton 12 as the screw cap 18 is twisted on and off pouring spout 15. Upon emptying of the contents from inner bag 14, the consumer depresses pouring spout 15 inwardly until heat stakes 66 and 67 are separated from top end panel 27. Separation is facilitated in that the diameter of heat stakes 66 and 67 is only slightly larger than the diameter of apertures 33 and 34 in top end panel 27. Opening flap 70 on side wall panel 44 may be opened after separation of the inner bag 14 from the outer carton 12 to facilitate removal of the inner bag 14 from the outer carton 12, as shown in FIG. 6. After separation of inner bag 14 from outer box 12, the two components can be placed into their respective recycling systems by the consumer.

An example of a preferred bag-in-box composite container has an overall height of 20.0cm. The outer carton is constructed of 28-point (0.028 inch thick) solid bleached sulfite carton board. The outer carton has a height of 18.1cm, a width of 9.53cm, and depth of 6.67cm. Top end panel and bottom end panel both have a width of 9.53cm and a depth of 6.67cm. The central aperture in the top end panel has a diameter of 3.35cm. The two small apertures on either side of the central aperture in the top end panel have a diameter of 4.25mm. The inner bag has a height of 22.86cm and width of 15.87cm. Prior to being exposed to a heat source the heat stakes have a diameter of 3.25mm, and length of 3.5mm as measured from the annular flange to their distal ends. After heating their distal ends, the heat stakes have a diameter of 4.75mm. The pouring spout has an inside diameter of 2.54cm and an outside diameter of 3.15cm. The annular flange has a diameter of 4.8cm. The opening flap in one of the side wall panels has a height of 12.0cm and a width of 3.5cm.

While particular embodiments of the present invention have been illustrated and described, modification may be made to the bag-in-box composite container without departing from the spirit and scope of the present invention. Accordingly, the present invention comprises all embodiments within the scope of the appended claims.

What is claimed is:

1. A bag-in-box composite container comprising:

(a) a rigid one-piece outer box being constructed from a unitary blank having a continuous side wall, a top end panel and a bottom end panel, said top end panel and said bottom end panel being joined to said side wall so as to define a hollow box cavity, said top end panel having a first aperture and at least two additional apertures therein; and (b) an inner bag being located within said hollow box cavity of said outer box, said inner bag having a pouring spout, said pouring spout having an outer surface and an annular flange, said pouring spout extending through said first aperture in said top end panel of said outer box, said annular flange of said pouring spout including an attachment means for preventing relative rotation between said pouring spout and said outer box and permitting easy separation of said inner bag from said outer box, said attachment means including at least two attachment members extending from said annular flange, said attachment members extending through said two additional apertures in said top end panel of said outer box and being adapted to temporarily secure said inner bag to said outer box.

2. The bag-in-box composite container according to claim 1, wherein said attachment means is separable from said top end panel with a downward force in the range of about 21.5 to about 56.8 newtons.

3. A bag-in-box composite container according to claim 1, wherein said inner bag and said pouring spout are made from compatible materials such that said inner bag and said pouring spout may be heat sealed to each other.

4. The bag-in-box composite container according to claim 1, wherein said outer box is constructed from a material selected from the group consisting of corrugated board, carton board or paperboard.

5. The bag-in-box composite container according to claim 1, wherein said pouring spout has closure receiving means projecting from said outer surface of said pouring spout.

6. The bag-in-box composite container according to claim 1, further comprising closure means releasably attached to said closure receiving means projecting from said outer surface of said pouring spout for securing said inner bag.

7. The bag-in-box composite container according to claim 1, further comprising easy opening means in said side wall for permitting removal of said inner bag from said outer box.

8. The bag-in-box composite container comprising:

(a) a rigid one piece outer box having a continuous side wall, a top end panel and a bottom end panel, said top end panel and said bottom end panel being joined to said side wall so as to define a hollow box cavity, said top end panel having a first aperture and at least two additional apertures therein; and (b) an inner plastic bag being located within said hollow box cavity of said outer box, said inner plastic bag having a pouring spout, said pouring spout having an outer surface and an annular flange, said pouring spout extending through said first aperture in said top end panel of said outer box, said annular flange of said pouring spout including at least two heat stakes for preventing relative rotation between said pouring spout and said outer box and permitting easy separation of said inner bag from said outer box, said heat stakes extending through said two additional apertures in said top end panel of said outer box and being adapted to temporarily secure said inner bag to said outer box.

9. The bag-in-box composite container according to claim 8, wherein said heat stakes are separable from said top end panel with a downward force in the range of about 21.5 to about 56.8 newtons.

10. The bag-in-box composite container according to claim 8, wherein said inner bag and said pouring spout are made from compatible materials such that said inner bag and said pouring spout may be heat sealed to each other.

11. The bag-in-box composite container according to claim 8, wherein said outer box is constructed from a unitary blank.

12. The bag-in-box composite container according to claim 11, wherein said outer box is constructed from a material selected from the group consisting of corrugated boar, carton board or paperboard.

13. The bag-in-box composite container according to claim 8, wherein said pouring spout has screw threads projecting from said outer surface of said pouring spout.

14. The bag-in-box composite container according to claim 13, further comprising a screw cap releasably attached to said screw threads projecting from said outer surface of said pouring spout.

15. The bag-in-box composite container according to claim 8, further comprising easy opening means in said side wall for permitting removal of said inner bag from said outer box.

16. The bag-in-box composite container comprising:

(a) a rigid one-piece outer box having a continuous side wall, a top end panel and a bottom end panel, said top end panel and said bottom end panel being joined to said side wall so as to define a hollow box cavity, said top end panel having a first aperture and at least two additional apertures therein;

(b) an inner plastic bag being located within said hollow box cavity of said outer box, said inner plastic bag having a pouring spout, said pouring spout having an outer surface and an annular flange, said outer surface of said pouring spout having screw threads projecting therefrom, said pouring spout extending through said first aperture in said top end panel of said outer box, said annular flange of said pouring spout including at least two heat stakes for preventing relative rotation between said pouring spout and said outer box and permitting easy separation of said inner bag from said outer box, said heat stakes extending through said two additional apertures in said top end panel of said outer box and being adapted to temporarily secure said inner bag to said outer box;

(c) easy opening means being located within said side wall of said outer box for permitting removal of said inner bag from said outer box; and (d) a screw cap releasably attached to the screw threads on the outer surface of said pouring spout.

17. The bag-in-box composite container according to claim 16, wherein said heat stakes are separable from said top end panel with a downward force in the range of about 21.5 to about 56.8 newtons.

18. The bag-in-box composite container according to claim 16, wherein said inner bag and said pouring spout are made from compatible materials such that said inner bag and said pouring spout may be heat sealed to each other.

19. The bag-in-box composite container according to claim 16, wherein said outer box is constructed from a paperboard unitary blank.

* * * * *